US007975494B2

(12) United States Patent
Boydstun et al.

(10) Patent No.: US 7,975,494 B2
(45) Date of Patent: Jul. 12, 2011

(54) CONTROL SYSTEM INTERFACE WITH DISPLAY FOR AIR CONDITIONING APPARATUS

(75) Inventors: Roger L. Boydstun, Tyler, TX (US); Robert W. Helt, Tyler, TX (US); Gordon Jeffrey Hugghins, Jacksonville, TX (US); Carl L. Garrett, Bullard, TX (US); Daniel J. Blair, Tyler, TX (US); Robert G. Royoroft, Whitehouse, TX (US); Timothy W. Storm, Tyler, TX (US)

(73) Assignee: Trane International, Inc., Piscataway, NJ (US)

( * ) Notice: Subject to any disclaimer, the term of this patent is extended or adjusted under 35 U.S.C. 154(b) by 714 days.

(21) Appl. No.: 11/906,678

(22) Filed: Oct. 3, 2007

(65) Prior Publication Data

US 2009/0090115 A1 Apr. 9, 2009

(51) Int. Cl.
*F25B 49/00* (2006.01)

(52) U.S. Cl. ..... 62/127; 62/125; 62/126; 62/129; 236/94

(58) Field of Classification Search ..... 62/125, 62/126, 127, 129; 23/94; 236/94; 165/11.1, 165/11.2

See application file for complete search history.

(56) References Cited

U.S. PATENT DOCUMENTS

| | | | | |
|---|---|---|---|---|
| 4,235,368 | A | 11/1980 | Neel | |
| 4,685,615 | A | 8/1987 | Hart | |
| 4,814,759 | A | 3/1989 | Gombrich et al. | |
| 5,145,137 | A | 9/1992 | Choi | |
| 5,326,027 | A | 7/1994 | Sulfstede | |
| D364,824 | S | 12/1995 | Warren et al. | |
| 6,098,411 | A | 8/2000 | Jeon | |
| 6,460,365 | B2 * | 10/2002 | Kim | 62/298 |
| 2003/0132923 | A1 * | 7/2003 | Hu | 345/179 |
| 2004/0227459 | A1 * | 11/2004 | Imura | 313/504 |
| 2005/0205735 | A1 * | 9/2005 | Ichikawa et al. | 248/292.12 |
| 2006/0256514 | A1 * | 11/2006 | Wang | 361/683 |
| 2008/0048046 | A1 * | 2/2008 | Wagner et al. | 236/91 R |

FOREIGN PATENT DOCUMENTS

GB 2176631 A 12/1986

OTHER PUBLICATIONS

McQuay Air Conditioning. Advertisement. PTAC/PTHP Packaged Terminal Air Conditioners and Heat Pumps. Dec. 25, 2005. Web Jun. 8, 2010. <http://www.mcquay.com/mcquaybiz/literature/lit_at_ptac/Brochures/PTACPTHP0105.pdf>.*

* cited by examiner

*Primary Examiner* — Cheryl J Tyler
*Assistant Examiner* — Jonathan Bradford
(74) *Attorney, Agent, or Firm* — Conley Rose, P.C.; J. Robert Brown, Jr.

(57) ABSTRACT

A user interface for a control system for an air conditioning apparatus includes a visual display and keys for scrolling menu items and entering commands to the control system. The interface is mounted in the apparatus cabinet and on a rotatable bracket to orient the interface for ease of reading the display and actuating the respective keys.

23 Claims, 5 Drawing Sheets

CONTROL SYSTEM INTERFACE WITH DISPLAY FOR AIR CONDITIONING APPARATUS

BACKGROUND OF THE INVENTION

In the art of heating, ventilating and air conditioning (HVAC) systems, often referred to as just air conditioning systems, there has been an ever increasing utilization of electronic-based or configured controls. The use of microprocessor based control systems for monitoring the status of an HVAC system, effecting control over operation of the system and the storage of suitable system identification information, fault signals and operating parameters has become desirable. As a consequence of the use of sophisticated electronic HVAC system controls there has been a need for a user interface or device which can display system information of the type described above and provide uncomplicated methods of making changes in control functions, displaying information, entering test modes of operation and entering selected control parameters for operation of the HVAC system.

Heretofore, HVAC system controls have required that control system changes and set-up functions use so-called jumpers, DIP switches and other mechanisms on an HVAC unit or cabinet, which cabinet may be located in a relatively inaccessible place such as in a basement, attic or closet within the structure being serviced by the HVAC equipment. Accordingly, there has been a strong need for a relatively uncomplicated device or interface which permits the user to conveniently view a wide-variety of information associated with set-up, servicing and troubleshooting HVAC equipment, which device is also friendly to be used by the actual user of the system, as well as to be used by a skilled technician or service representative. The present invention provides the improvements needed as described above and as will be appreciated by those skilled in the art.

SUMMARY OF THE INVENTION

The present invention provides a display module assembly or user interface for use in operation of HVAC systems or apparatus.

In accordance with one aspect of the present invention, a so-called module, unit or user interface is provided which includes a visual display and a relatively uncomplicated keypad or set of keys which may be user actuated to navigate through a menu of information to be accessed and select various control inputs to a control system for an HVAC apparatus or system. The interface module may provide for the display of information related to the apparatus operating mode, the apparatus model number and serial number, an address where the apparatus is located, an address and communication information for calling for service, identifiers for at least selected parts of the apparatus, error codes, test modes and other system set-up options specific to the user of the apparatus or to a service technician, setting up, servicing or troubleshooting defects or faults in the apparatus.

In accordance with another aspect of the invention, a user interface module is provided which may be mounted within a cabinet of a unit of HVAC or air conditioning equipment and may be more easily viewed and used by a user of the interface. The interface module may be conveniently removed and replaced, if needed, and provides an uncomplicated, relatively inexpensive device for displaying information, setting up control features and otherwise providing for operation and servicing of air conditioning apparatus in an easily readable and useable form. The interface module is also advantageously adapted to be immune to environmental conditions of high humidity and variations in ambient barometric pressures, for example.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
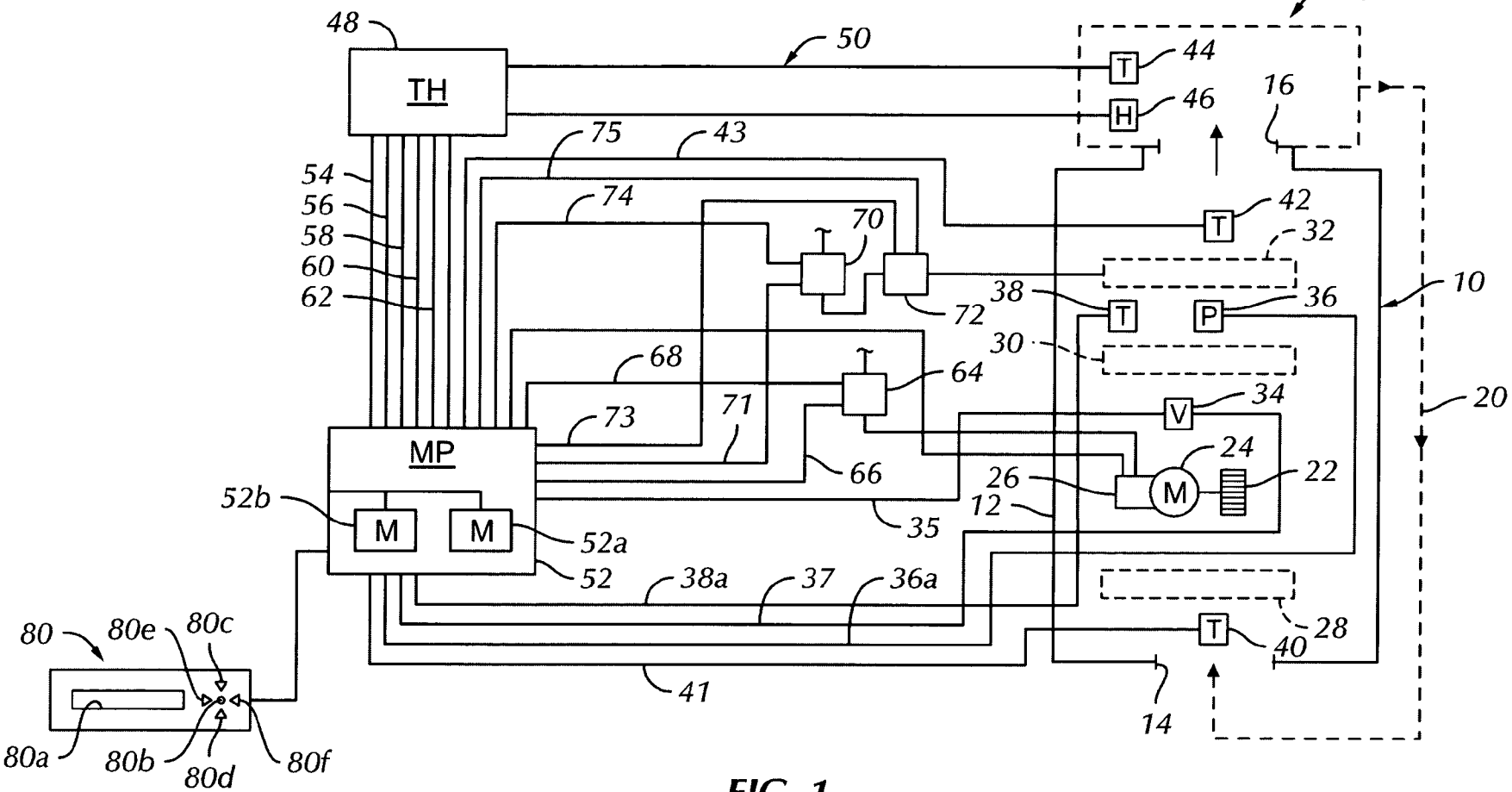
FIG. 1 is a schematic diagram of a control system for an air conditioning apparatus including the display module or user interface of the present invention.

In the description which follows like elements are marked throughout the specification and drawing with the same reference numerals, respectively. The drawing figures may not be to scale and certain features may be shown schematically or in somewhat generalized form in the interest of clarity and conciseness.

Referring to FIG. 1, there is illustrated a diagram of an air conditioning apparatus 10 which may take various forms, but in the embodiment illustrated, is shown to include a cabinet 12 having an air inlet or return air opening 14 and an air discharge opening 16 connected by suitable ducting to an enclosed space 18. Apparatus 10 may include a motor driven blower or fan 22 connected to an electric drive motor 24 which may include its own control unit 26, as shown. Blower 22 is disposed within cabinet 12 typically in a flow path wherein air entering the cabinet may flow over a cooling coil type heat exchanger 28, then through blower 22 to a heat exchanger 30, which may comprise a combustion furnace, for example. Other types of air heating means may be disposed in cabinet 12 including an electric resistance grid type heater 32. In a combustion furnace there is typically an electrically operated gas flow control valve 34 and pressure and temperature sensors 36 and 38 associated with furnace 30 for monitoring the combustion process and other operating parameters of the combustion furnace. Combustion furnace 30 may also include a motor driven inducer blower, not shown, for drawing air and combustion gases through the furnace heat exchanger. Additional temperature sensors may include a return air sensor 40, a discharge temperature sensor 42, a sensor 44 within space 18 and, possibly, a humidity sensor 46 for sensing the humidity within the space 18. Sensors 44 and 46 are connected to a thermostat type controller 48, as indicated.

An exemplary control system for the apparatus 10 is indicated generally by the numeral 50 and includes a microprocessor 52, including components 52*a* and 52*b* therein on which certain control and operating program(s) reside.

Microprocessor 52 is operably connected to the thermostat 48 via one or more signal conductors which may include conductors 54, 56, 58, 60 and 62 which may provide signals to the microprocessor for such operations as a first stage call for heat, a second stage call for heat, a first cooling stage call, a continuous fan operating mode and, possibly, a heat pump operating signal. The apparatus 10 typically includes a vapor compression compressor and condenser unit, not shown, operably connected to the cooling coil 28 and possibly configured for either air cooling operation only or heat pump operation. For a particular configuration of the apparatus 10, control system 50 may include a motor control relay 64 operable to receive a signal from microprocessor 52 by way of a conductor 66 wherein a feedback signal may be input to the microprocessor via a conductor 68. Still further, electric heating element 32 may include a control relay 70, an interlock relay 72 operable to receive signals from the microprocessor 52 by way of conductors 71 and 73 and with relay status feedback signals input to the microprocessor via conductors 74 and 75. Temperature sensors 40 and 42 provide input signals to the microprocessor by way of conductors 41 and 43, and combustion furnace control valve 34 receives a signal via conductor 35 which is output by the microprocessor 52. A status feedback signal may be via a conductor 37. Sensors 36 and 38 provide signals to the controller 52 via conductors 36*a* and 38*a*, respectively.

As further shown in FIG. 1, microprocessor 52 is advantageously connected to an interface module in accordance with the invention and generally designated by the numeral 80. Interface 80 includes a visual display 80*a* and user operable keys 80*b*, 80*c*, 80*d*, 80*e* and 80*f*, see FIG. 3 also. Key 80*b* may be used to make commands, such as entering selected information to microprocessor 52 and which has been selected from viewing display 80*a* and from scrolling through a menu of displayed items by actuation of the keys 80*c*, 80*d*, 80*e* and 80*f*, respectively. Keys 80*b*, 80*c*, 80*d*, 80*e* and 80*f* are preferably formed on a membranelike member overlying respective switches responsive to depression of the keys by a user of the interface.

Figure 2:
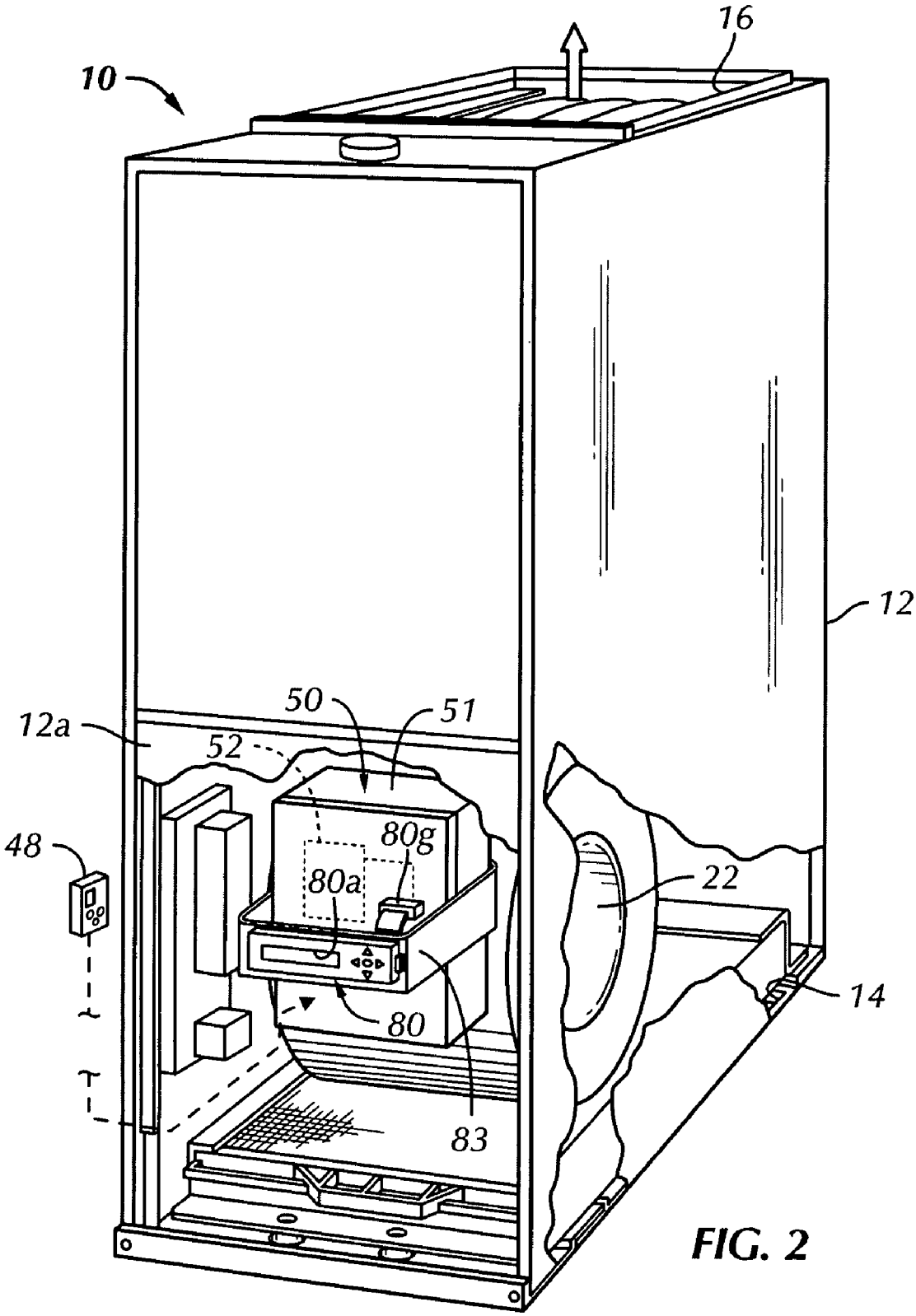
FIG. 2 is a perspective view of a typical air conditioning apparatus illustrating a preferred mounting arrangement for the interface.

Referring now to FIG. 2, there is illustrated one preferred mounting arrangement for the interface 80. As shown in FIG. 2, the interface 80 is disposed within the interior of the apparatus cabinet 12 and may, for example, be mounted on a suitable enclosure 51 which encloses the control system 50. A somewhat U-shaped bracket 83, FIG. 2, may be provided to suitably support the interface 80 in a position where a user of the apparatus 10 or a service technician may have access to the interface by removing a panel 12*a* of cabinet 12, which panel is shown substantially broken away in FIG. 2. Interface 80 may be connected to the control system 50 by way of a suitable ribbon cable and connector assembly 80*g*, illustrated in FIG. 2, as well as in FIGS. 3, 4, and FIG. 5, in particular.

Figure 3:
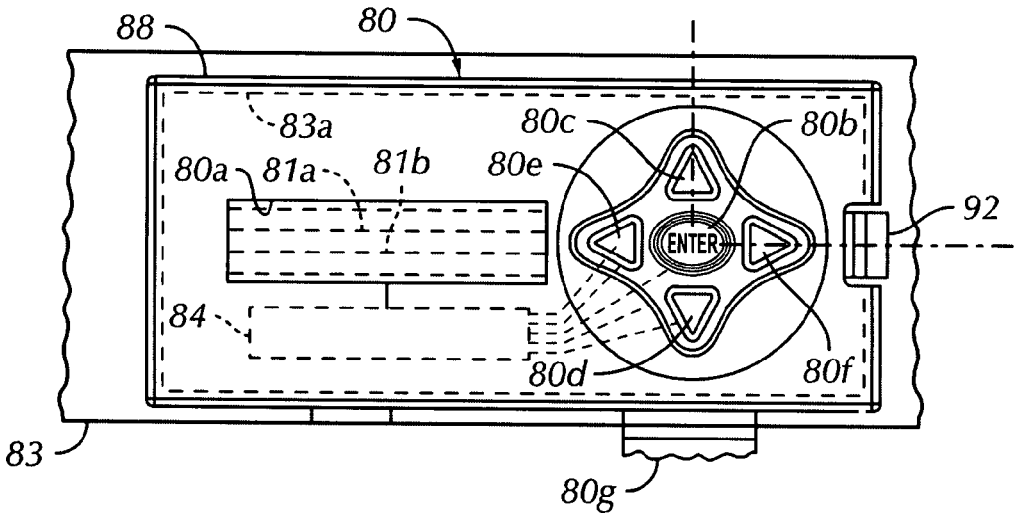
FIG. 3 is a front elevation of the interface shown in FIG. 2.
Figure 4:
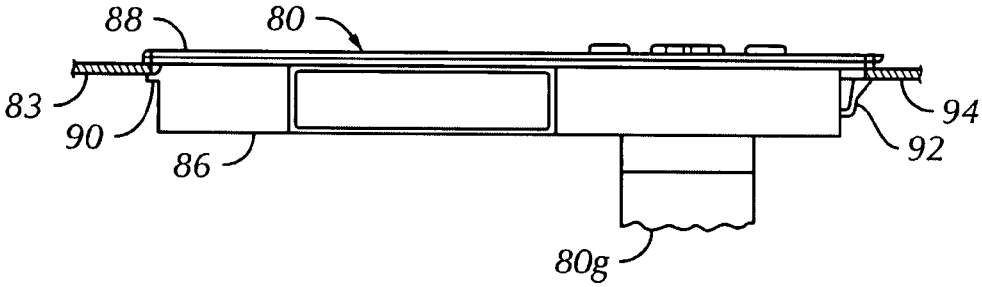
FIG. 4 is a longitudinal side view of the user interface.
Figure 5:
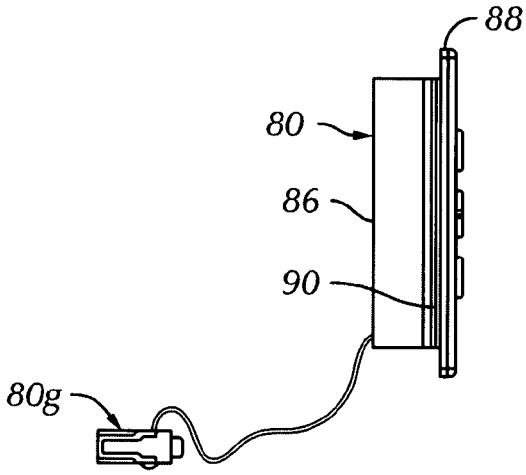
FIG. 5 is an end view of the interface or module shown in FIGS. 2, 3 and 4.

Referring to FIGS. 3, 4 and 5, the interface 80 may have its own processor or control circuit 84, FIG. 3, operably connected to the keys 80*b*, 80*c*, 80*d*, 80*e* and 80*f* as well to the display 80*a*. Interface 80 includes a generally rectangular housing 86 provided with a face part 88, which extends beyond the perimeter of housing 86, a transverse shoulder or groove 90 at one end of the housing and a resilient latch 92 at the opposite end of the housing, see FIG. 8 also. Latch 92 is constructed such that the interface 80 may be snap fitted into a suitable opening 83*a* formed in bracket 83, as indicated in FIG. 3.

Figure 8:
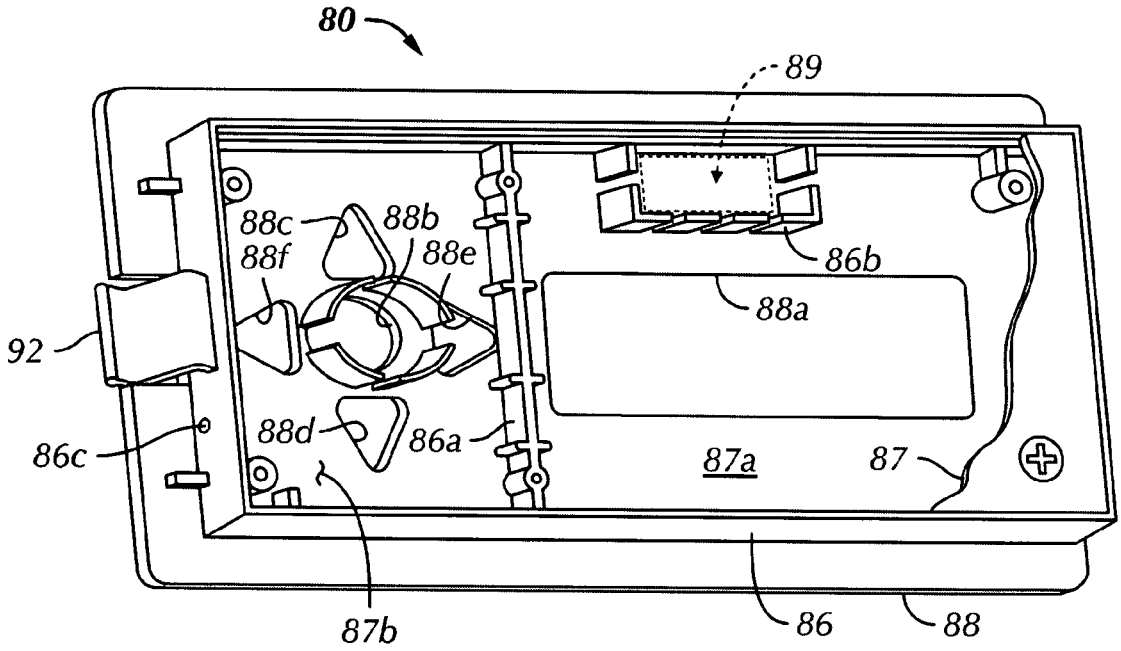
FIG. 8 is a perspective view of the interface housing illustrating certain features.

Referring to FIG. 8, face part 88 includes a transparent window portion 88*a* of face part 88 and openings 88*b*, 88*c*, 88*d*, 88*e* and 88*f* for receiving keys 80*b*, 80*c* 80*d*, 80*e* and 80*f*, respectively. A removable back cover 87 cooperates with an intermediate transverse wall 86*a* of housing 86, a gasket, not shown, and housing 86 to isolate a space 87*a* substantially hermetically. An enclosure 86*b* in space 87*a* supports a suitable desiccant packet 89. A second compartment or space 87*b* in housing 86 is vented to atmosphere by way of a passage 86*c* in housing 86 to prevent changes in ambient atmospheric pressures from depressing keys 80*b*, 80*c*, 80*d*, 80*e* and 80*f*. Passage 86*c* may be fitted with suitable means, such as a membrane type vent device, not shown, to prevent water or other liquids from entering space 87*b* while still allowing for pressure equalization.

Figure 6:
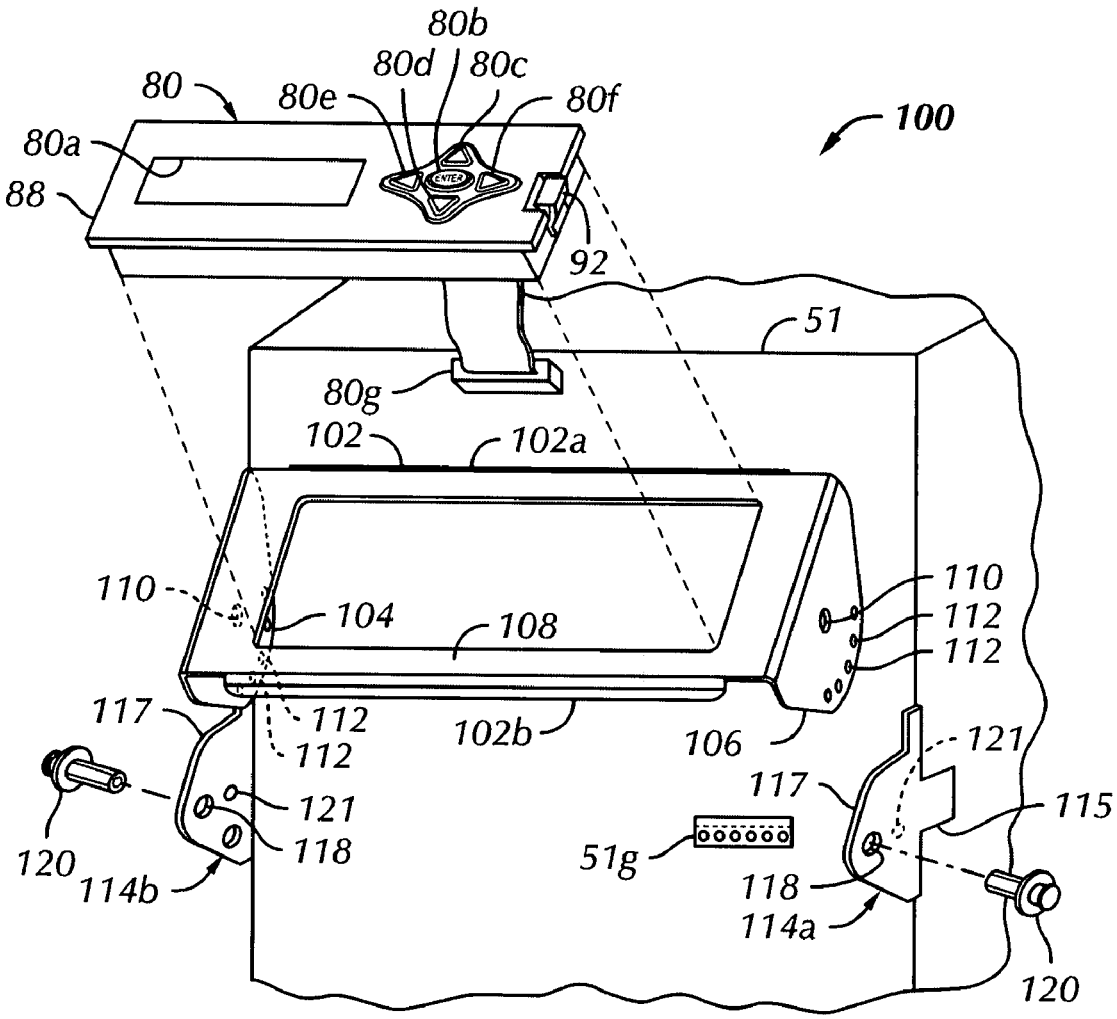
FIG. 6 is a perspective view showing another preferred arrangement of mounting the interface.
Figure 7:
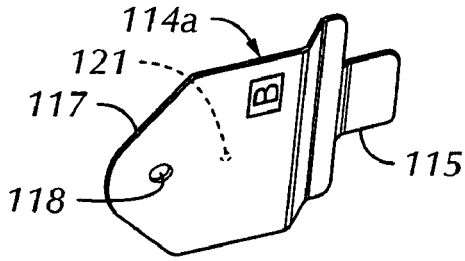
FIG. 7 is a perspective view of one of the support brackets for the mounting arrangement illustrated in FIG. 6.

Referring now to FIGS. 6 and 7, in many applications of apparatus, such as the apparatus 10, the position or orientation of the apparatus is such that it is difficult to read the display 80*a* of the interface 80, as well as actuate the respective keys 80*b* through 80*f* during use of the interface. In this regard, it is advantageous to provide a support or mounting bracket illustrated and generally designated by the numeral 100. Support or mounting bracket 100 includes a support member 102 comprising opposed integrally formed flanges 104 and 106 which extend at right angles to and are disposed at opposite ends of a flat plate part 108 having a generally rectangular cutout or opening 109 formed therein for receiving the interface 80. The flanges 104 and 106 are each provided with a first opening 110, and a series of smaller openings 112 formed on an arc and through a range of about ninety degrees with respect to the common axis of the openings 110. Flange 104 is virtually identical to flange 106 with respect to being provided with openings 110 and 112. Bracket support member 102 also includes opposed depending flanges 102*a* and 102*b* to facilitate grasping the support member.

Mounting bracket or support 100 further includes opposed support members 114*a* and 114*b* which may be adapted to be mounted on the enclosure 51 in place of the bracket 83, as indicated in FIG. 6. Support members 114*a* and 114*b* each include a mounting tab 115 which may be suitably fastened to the enclosure 51 and a flange 117 having suitable spaced apart openings 118 and 119 formed therein. Openings 118 may be aligned with the openings 110 for mounting the bracket member 102 on the support members 114*a* and 114*b* at the respective flanges 104 and 106 whereby rivet type fasteners or pivot pins 120, FIG. 6 may be inserted through the respective openings 118 and 110, for example, to support the bracket member 102 pivotally with respect to the enclosure 51. Each of bracket support members 114*a* and 114*b* includes a small detent projection 121 formed thereon and operable to register with one of the openings 112 so that the support member 102 may be retained in a selected rotative working position with respect to the enclosure 51, which is advantageous for viewing the display 80*a* and actuating the keys 80*b*, 80*c*, 80*d*, 80*e* and 80*f*, depending on the orientation of the apparatus 10 and accessibility thereto by a user or service technician. Accordingly, an advantageous mounting arrangement for the user interface module 80 is provided by the 100 illustrated in FIG. 6. As shown in FIG. 6, enclosure 51 for control system 50 also includes a suitable connector member 51*g* for receiving the connector assembly 80*g* for the interface 80.

Those skilled in the art will recognize that the interface 80 is an advantageous device for use in conjunction with air conditioning apparatus, such as the apparatus 10. The display 80*a* may be a two-line sixteen character dot matrix LCD type display for displaying alpha-numeric characters on lines 81*a* and 81*b*, FIG. 3. The keys 80*c*, 80*d*, 80*e* and 80*f* may be used to navigate a menu structure associated with or resident on the processors 84 and/or 52. On power-up, backlighting may be provided for the display 80*a* and with a time delay, if there is no activity, before backlighting is extinguished. Backlighting will typically be enabled when any of the keys on the interface 80 are pressed. Multiple menu loops may be provided for the operation of the interface.

On completion of a power-up sequence, the model number and serial number of apparatus 10 may be displayed, for example. Any left, right or enter key press will cause the interface to enter a control mode menu loop, for example. Any up or down key press will cause the interface 80 to enter a system status menu loop, for example. The system status menu loop may contain information about the operational status of the apparatus 10. The interface 80 may display a system status menu item on the first line 81*a* and a blinking cursor at the left end of second line 81*b*. If no data is available or cannot be retrieved the term "no data" may be displayed on the line 81*b*.

If the system status menu loop is operable, an up/down key press will cause the interface 80 to scroll through system status menu options. When scrolling with the "up" arrow key 80*c* a cursor moves to the first line 81*a* of the display and when scrolling with the "down" arrow key 80*d*, a cursor moves to the second line 81*b* of the display to indicate an item to be selected. On exit from the aforementioned loop, the operable control program may return the display 80*a* to a standby screen status, for example.

Still further, when the interface 80 is in a system status options mode, the selected menu option may appear on the first line 81*a* of the display 80*a* and available data/choices and current or present active selected items may appear on the second line 81*b* of the display. The keys 80*e* and 80*f* are used to scroll through available data and choices for control of the apparatus 10 and a cursor location will be indicated by blinking the first character on the appropriate line of the display. Of course, the key 80*b* is used to select the desired option indicated by the blinking cursor. If, for example, a temperature reading is being displayed and is out of range the display 80*a* will read "out of range".

A contingency mode of operation of the apparatus 10 may be entered using the interface 80 and certain menu options may require a "yes/no" response and "no" will always be a default or current active selection. Menu items and units which may be displayed and manipulated include system status/mode, requested air flow (CFM), plural ones of the most recent faults encountered by the system or apparatus 10 and an identification of operating alarm codes, for example. Display of temperature sensor data, and blower and draft inducer motor speeds and resetting more recent faults may be carried out via the interface 80.

In addition to the foregoing conveniences and operations that may be carried out using the interface 80, a unit menu loop may be programmed into the control system 50 to include system installer setup information for the applicable apparatus. For example, an installer may use a variety of selections to configure the apparatus 10 to operate with a selected type of control or thermostat and plural menu loops may be provided, one of which is selected according to the type of equipment being used. A separate module connectable to control system 50 may be provided for storing specific system data for apparatus 10, as disclosed in copending U.S. patent application Ser. No. 11/717,466, filed Mar. 13, 2007 by Robert W. Helt, et al., and assigned to the assignee of the present invention. Parameters such as airflow (in CFM), the number of cooling or heating stages, a continuous fan or blower mode, percent of maximum fan or blower speed, pre-run delay of the fan, heating airflow, heating off delay and all factory defaults may be selected, for example. Although programming of the interface 80 may not be required, such programming would be required of the controller processor 52, for example. Thus, the control system 50 may write information to the display 80*a* in a manner and speed such that the writing of individual characters is not detectable to a viewer. Various data suffixes, units of measure, abbreviations, symbols and notes may be programmed for display by the display 80*a* and for selecting a certain operating parameter of the apparatus 10 via the control system 50.

Those skilled in the art will recognize that the module or interface 80 provides advantages heretofore unrealized in HVAC equipment. Thanks also to the configuration of the interface 80 and the supports 83 and 100, advantageous orientation of the display in a selected position is obtainable, particularly with the support 100, as indicated in the drawings and described hereinabove. The foregoing description is believed to be sufficient to enable one skilled in the art to practice the invention. Commercially available components and known engineering materials and practices may be used to carry out the invention, as described. Although preferred embodiments have been described in detail, those skilled in the art will also recognize that various substitutions and modifications may be made without departing from the scope and spirit of the appended claims.

What is claimed is:

1. An air conditioning apparatus including a cabinet, a motor driven blower disposed in said cabinet, at least one heat exchanger disposed in said cabinet for one of heating and cooling air flowing through said cabinet to an enclosed space, a thermostat including a temperature sensor adapted to be disposed in said enclosed space and means for communicating signals from said thermostat to a control system for said apparatus, said control system including a processor, the apparatus further comprising:

a user interface disposed in said cabinet to be substantially inaccessible from the outside of said cabinet during normal operation of said apparatus, wherein said interface is positioned in a space within said cabinet associated with an air input of the blower, wherein accessing said interface causes an alteration of a flow path associated with said blower, said interface being operably connected to said control system for communicating a plurality of parameters associated with said apparatus, and said interface comprising a visual display configured to selectively display selected ones of said parameters and plural keys selectively operable to control selected ones of said parameters.

2. The apparatus set forth in claim 1 wherein:

said plural keys are operable to select certain ones of said parameters for controlling operation of said apparatus via a program associated with said control system.

3. The apparatus set forth in claim 1 wherein:

said interface includes a connector for releasably connecting said interface to said control system.

4. The apparatus set forth in claim 1, further comprising:

a support for said interface disposed in said cabinet.

5. The apparatus set forth in claim 4, wherein:

said support is mounted on an enclosure for said control system.

6. The apparatus set forth in claim 4 wherein:

said support is disposed in said cabinet for limited movement to facilitate orienting said display with respect to a user of said interface.

7. The apparatus set forth in claim 6 wherein:

said support includes a plate portion for receiving said interface, opposed flanges connected to means disposed in said cabinet for limited rotation of said support and detent means cooperating with said flanges for securing said support and said interface in a selected position.

8. The apparatus set forth in claim 7 including:

pivot pins interconnecting said support with said means in said cabinet for providing limited rotation of said support.

9. The apparatus set forth in claim 1 wherein:

said plural keys include directional keys for scrolling through menu items on said display including opposed up and down keys and opposed left and right keys.

10. The apparatus set forth in claim 1, wherein said parameters are selected from the group consisting of a parameter to control the operation of the HVAC system, a parameter for entering test modes of operation, a parameter related to an apparatus operating mode, an apparatus model number, an apparatus serial number, an address associated with said apparatus, an identifier for at least selected parts of said apparatus, an error code, a test mode, a system set-up option specific to a user of said apparatus, a system set-up option specific to a service technician, a parameter to service said apparatus, a parameter to troubleshoot faults in said apparatus, a temperature sensor related parameter, and a blower related parameter.

11. An air conditioning apparatus including a cabinet, a motor driven blower disposed in said cabinet, at least one heat exchanger disposed in said cabinet for one of heating and cooling air flowing through said cabinet to an enclosed space, a thermostat including a temperature sensor adapted to be disposed in said enclosed space and means for communicating signals from said thermostat to a control system for said apparatus, said control system including a processor, the apparatus further comprising:

a user interface disposed in said cabinet to be substantially inaccessible from the outside of said cabinet during normal operation of said apparatus, wherein accessing said interface causes an alteration of a flow path associated with said blower, said interface being operably connected to said control system for communicating a plurality of parameters associated with said apparatus, said interface comprising a display configured to selectively alphanumerically display selected ones of said parameters and a user actuated keypad for controlling the operation of said apparatus; and a support for said interface disposed in said cabinet.

12. The apparatus set forth in claim 11 wherein: said support is mounted on an enclosure for said control system.

13. The apparatus set forth in claim 11 wherein:

said support is disposed in said cabinet for limited movement to facilitate orienting said display with respect to a user of said interface.

14. The apparatus set forth in claim 13 wherein:

said support includes a plate portion for receiving said interface, opposed flanges connected to means disposed in said cabinet for limited rotation of said support and detent means cooperating with said flanges for securing said support and said interface in a selected position.

15. The apparatus set forth in claim 11 wherein:

said user actuated keypad includes plural keys including directional keys for scrolling through menu items on said display including opposed up and down keys and opposed left and right keys.

16. The apparatus set forth in claim 11, wherein:

said parameters are selected from the group consisting of a parameter to control the operation of the HVAC system, a parameter for entering test modes of operation, a parameter related to an apparatus operating mode, an apparatus model number, an apparatus serial number, an address associated with said apparatus, an identifier for at least selected parts of said apparatus, an error code, a test mode, a system set-up option specific to a user of said apparatus, a system set-up option specific to a service technician, a parameter to service said apparatus, a parameter to troubleshoot faults in said apparatus, a temperature sensor related parameter, and a blower related parameter.

17. The apparatus set forth in claim 11 wherein:

said interface includes a housing defining first and second interior spaces, one of said spaces including said display and a desiccant disposed in said one space.

18. The apparatus set forth in claim 17 wherein:

said housing includes a vent passage formed therein for venting the other of said spaces to ambient atmospheric pressure.

19. An air conditioning apparatus including a cabinet, a motor driven blower disposed in said cabinet, at least one heat exchanger disposed in said cabinet for one of heating and cooling air flowing through said cabinet to an enclosed space, a thermostat including a temperature sensor adapted to be disposed in said enclosed space and means for communicating signals from said thermostat to a control system for said apparatus, said control system including a processor, the apparatus further comprising:

a user interface disposed in said cabinet to be substantially inaccessible from the outside of said cabinet during normal operation of said apparatus, wherein said interface is positioned in a space within said cabinet associated with an air input of the blower, wherein accessing said interface causes an alteration of a flow path associated with said blower, said interface being operably connected to said control system, said interface including a visual display configured to selectively display a parameter selected from the group consisting of a parameter to control the operation of the HVAC system, a parameter for entering test modes of operation, a parameter related to an apparatus operating mode, an apparatus model number, an apparatus serial number, an address associated with said apparatus, an identifier for at least selected parts of said apparatus, an error code, a test mode, a system set-up option specific to a user of said apparatus, a system set-up option specific to a service technician, a parameter to service said apparatus, a parameter to troubleshoot faults in said apparatus, a temperature sensor related parameter, and a blower related parameter.

20. The apparatus set forth in claim 19, further comprising:

a user operable control pad to select certain ones of said parameters for controlling operation of said apparatus via a program associated with said control system.

21. The apparatus set forth in claim 20 wherein:

said user operable control pad comprises plural keys including directional keys for scrolling through menu items on said display including opposed up and down keys and opposed left and right keys.

22. The apparatus set forth in claim 19, further comprising:

a support for said interface disposed in said cabinet for limited movement to facilitate orienting said display with respect to a user of said interface.

23. The apparatus set forth in claim 22 wherein:

said support includes a plate portion for receiving said interface, opposed flanges connected to means disposed in said cabinet for limited rotation of said support and detent means cooperating with said flanges for securing said support and said interface in a selected position.

* * * * *